US007535453B2

(12) United States Patent
Lee

(10) Patent No.: US 7,535,453 B2
(45) Date of Patent: May 19, 2009

(54) BRIGHTNESS CONTROL APPARATUS AND METHOD FOR A VIDEO DISPLAY APPLIANCE

(75) Inventor: Sim Hong Lee, Daegu (KR)

(73) Assignee: LG Electronics Inc., Seoul (KR)

( * ) Notice: Subject to any disclaimer, the term of this patent is extended or adjusted under 35 U.S.C. 154(b) by 407 days.

(21) Appl. No.: 11/002,666

(22) Filed: Dec. 3, 2004

(65) Prior Publication Data

US 2005/0122063 A1 Jun. 9, 2005

(30) Foreign Application Priority Data

Dec. 5, 2003 (KR) ..... 10-2003-0088288

(51) Int. Cl.
*G09G 3/36* (2006.01)

(52) U.S. Cl. ..... 345/102; 345/690

(58) Field of Classification Search ..... 315/291, 315/307, 308; 345/77, 204, 102, 690
See application file for complete search history.

(56) References Cited

U.S. PATENT DOCUMENTS 5,854,617 A * 12/1998 Lee et al. ..... 345/102
5,952,992 A * 9/1999 Helms ..... 345/102
6,891,525 B2 * 5/2005 Ogoro ..... 345/102
6,967,647 B2 * 11/2005 Nokiyama ..... 345/204
2003/0206163 A1 * 11/2003 Kee ..... 345/204
2005/0146496 A1 * 7/2005 Nguyen et al. ..... 345/102

FOREIGN PATENT DOCUMENTS

CN 1432906 A 7/2003

* cited by examiner

*Primary Examiner*—Douglas W Owens
*Assistant Examiner*—Ephrem Alemu
(74) *Attorney, Agent, or Firm*—KED & Associates, LLP

(57) ABSTRACT

Disclosed are a brightness control apparatus and method for a video display appliance that can lengthen the lifetime of a lamp and reduce the power consumption of the lamp by automatically entering into a lamp power saving mode if a display brightness is manually adjusted below a predetermined brightness value. The brightness control apparatus includes a memory for storing various kinds of menus for controlling an operation of the appliance, a display unit for displaying the menus stored in the memory and a video signal, a control unit for operating to automatically switch a present mode over to a lamp power saving mode according to a result of comparing a display brightness value being adjusted by a user with a reference brightness value prestored in the memory if the user selects a menu for adjusting the brightness from the menus being displayed on the display unit, and a lamp driving unit for driving a lamp according to a control signal output from the control unit.

16 Claims, 4 Drawing Sheets

BRIGHTNESS CONTROL APPARATUS AND METHOD FOR A VIDEO DISPLAY APPLIANCE

BACKGROUND OF THE INVENTION

1. Field of the Invention

The present invention relates generally to a video display appliance, and more particularly to a brightness control apparatus and method that can lengthen the lifetime of a lamp and reduce a power consumption for a video display appliance using the lamp such as a projector and a projection television receiver (TV).

2. Description of the Related Art

Recently, as the development of large-sized ultra-thin displays becomes active due to the limitations of screen size of the existing TVs, projection type display systems have notably been developed. Additionally, the spread of projectors and projection display appliances using a display device such as a CRT (Cathode Ray Tube), an LCD (Liquid Crystal Display), an LCoS (Liquid Crystal on Silicon), a DLP (Digital Light Processing), etc., has abruptly been increased.

The LCD, which is one of flat-panel display devices, has a superior visibility, a small average power consumption, and a small amount of heat generation in comparison to the CRT, and thus has been spotlighted as the next-generation display device of a cellular phone, a computer monitor, a TV, etc., along with a PDP (Plasma Display Panel) and an FED (Field Emission Display).

The projection display appliance having the LCD as its display device is a video display system that emits the three primary colors of red, green and blue, projects and enlarges an image using a projection lens and a reflecting mirror to form the final image on a screen.

The LCD has the structure in that a liquid crystal material is injected between two thin surface-processed glass plates having electrodes formed thereon, and operates to display an image by producing light and darkness through the change of arrangement of liquid crystal molecules due to the voltage difference between the electrodes. Because the LCD panel itself cannot emit light, a light source such as a lamp is required in order for a user to visually recognize the image or text displayed on the LCD panel.

In driving the LCD panel, a dimmer mode (i.e., a lamp power saving mode) may be performed to lengthen the lifetime of the light source. This lamp power saving mode is to lower the brightness of the lamp by supplying the lamp with a power that is smaller than that required for the maximum brightness of the lamp if the bright light is not required for the display, for example, in the dark room or in the case that a movie is displayed on the LCD panel.

By lowering the brightness of the lamp, the power consumption is reduced and the lifetime of the lamp is lengthened. Practically, in the case of viewing a movie through a projector in the room, the display screen is so bright as to dazzle to the user's eyes, and the user may use the lamp power saving mode. If the lamp power saving function is not provided in the display appliance, the user may adjust the display brightness using a menu for adjusting the brightness.

For the purpose of simply lowering the display brightness, it is much more effective in power consumption and lifetime of the lamp to use the lamp power saving mode in comparison to the lowering of the brightness value using the menu for adjusting the brightness. However, on the ground that users think it much trouble to use the lamp power saving mode or do not know what the lamp power saving mode itself is for, the lamp power saving mode may not be properly used.

If the display brightness is adjusted to dark in a state that the operating video display appliance is not in the lamp power saving mode, the power consumption is not reduced and the lifetime of the lamp is not lengthened in comparison to the state that the video display appliance operates in the lamp power saving mode.

SUMMARY OF THE INVENTION

The present invention is directed to a brightness control apparatus and method regulator for a video display appliance that substantially obviates one or more problems due to limitations and disadvantages of the related art.

It is an object of the present invention to provide a brightness control apparatus and method for a video display appliance that can lengthen the lifetime of a lamp by automatically entering into a lamp power saving mode if a display brightness is manually adjusted below a predetermined brightness value.

It is another object of the present invention to provide a brightness control apparatus and method for a video display appliance that can reduce the power consumption of the lamp.

To achieve this object and other advantages in accordance with the purpose of the present invention, as embodied and broadly described herein, there is provided a brightness control apparatus for a video display appliance having a lamp, comprising a memory for storing various kinds of menus for controlling an operation of the appliance, a display unit for displaying the menus stored in the memory and a video signal, a control unit for operating to automatically switch a present mode over to a lamp power saving mode according to a result of comparing a display brightness value being adjusted by a user with a reference brightness value pre-stored in the memory if the user selects a menu for adjusting the brightness from the menus being displayed on the display unit, and a lamp driving unit for driving the lamp according to a control signal output from the control unit.

Preferably, the control unit operates to automatically switch the present mode to the lamp power saving mode if the brightness value adjusted by the user through the key input unit is smaller than the reference brightness value pre-stored in the memory.

Preferably, the menu for adjusting the brightness includes menus for a first brightness mode for adjusting a general brightness and a second brightness mode for adjusting the brightness in the lamp power saving mode.

In another aspect of the present invention, there is provided a brightness control method for a video display appliance having a lamp and a memory, comprising the steps of outputting video and audio signals if a power is applied to the appliance, displaying various kinds of menus pre-stored in the memory according to a user's menu selection, and controlling to automatically switch a present mode over to a lamp power saving mode according to a result of comparing a display brightness value being adjusted by a user with a reference brightness value pre-stored in the memory if the user selects a menu for adjusting the brightness with reference to the menus being displayed on the display unit.

Preferably, the step of displaying the various kinds of menus pre-stored in the memory displays a menu for adjusting contrast and color, a first brightness adjustment menu for adjusting the brightness in a general mode, and a second brightness adjustment menu for adjusting the brightness in the lamp power saving mode.

Preferably, the step of controlling to automatically switch the present mode over to the lamp power saving mode comprises the sub-steps of judging whether the lamp power saving mode is pre-selected if the user selects the menu for adjusting the brightness with reference to the displayed menus, judging whether the brightness value adjusted using the first brightness adjustment menu is smaller than the reference brightness value pre-stored in the memory if the lamp power saving mode is not selected, and automatically switching the present mode over to the lamp power saving mode if the adjusted brightness value is smaller than the reference brightness value pre-stored in the memory as a result of judgment.

Additionally, the step of controlling to automatically switch the present mode over to the lamp power saving mode further comprises the sub-steps of adjusting the brightness using the second brightness adjustment menu if the lamp power saving mode is pre-selected, and releasing the lamp power saving mode if the adjusted brightness value is a maximum value of the second brightness adjustment menu.

In still another aspect of the present invention, there is provided a brightness control apparatus for a video display appliance having a lamp, comprising a memory for storing various kinds of menus for controlling an operation of the appliance, a surrounding brightness sensing unit for sensing a surrounding brightness of the video display appliance, a control unit for operating to automatically switch a present mode over to a lamp power saving mode according to a result of comparing the surrounding brightness sensed by the surrounding brightness sensing unit with a preset reference brightness, and a lamp driving unit for driving the lamp according to a control signal output from the control unit.

Preferably, the control unit operates to automatically switch the present mode to the lamp power saving mode if the surrounding brightness sensed by the surrounding brightness sensing unit is lower than the preset reference brightness.

In still another aspect of the present invention, there is provided a brightness control method for a video display appliance having a lamp and a surrounding brightness sensing unit, comprising the steps of outputting video and audio signals and sensing a surrounding brightness through the surrounding brightness sensing unit if a user inputs a power-on command, and controlling to switch a present mode over to a lamp power saving mode according to a result of comparing the sensed surrounding brightness with the preset reference brightness.

Preferably, the step of controlling to switch the present mode over to the lamp power saving mode comprises the sub-steps of switching the present mode over to the lamp power saving mode if the sensed surrounding brightness is lower than the preset brightness, and releasing the lamp power saving mode if the sensed surrounding brightness is higher than the preset brightness after the present mode is switched over to the lamp power saving mode.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Wherever possible, the same reference numbers will be used throughout the drawings to refer to the same or similar parts.

Figure 1:
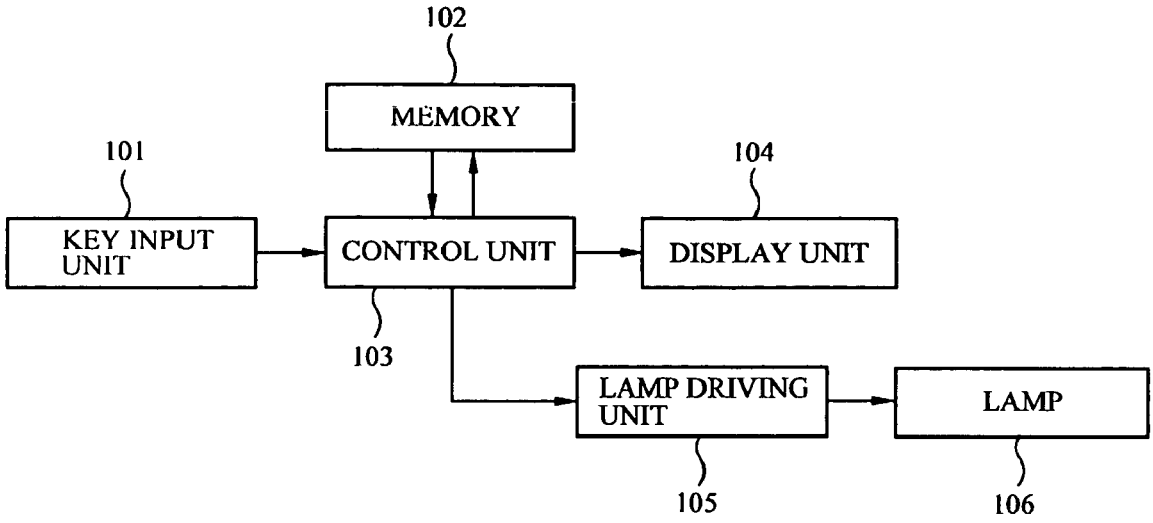
FIG. 1 is a block diagram illustrating a brightness control apparatus for a video display appliance according to an embodiment of the present invention.
Figure 2:
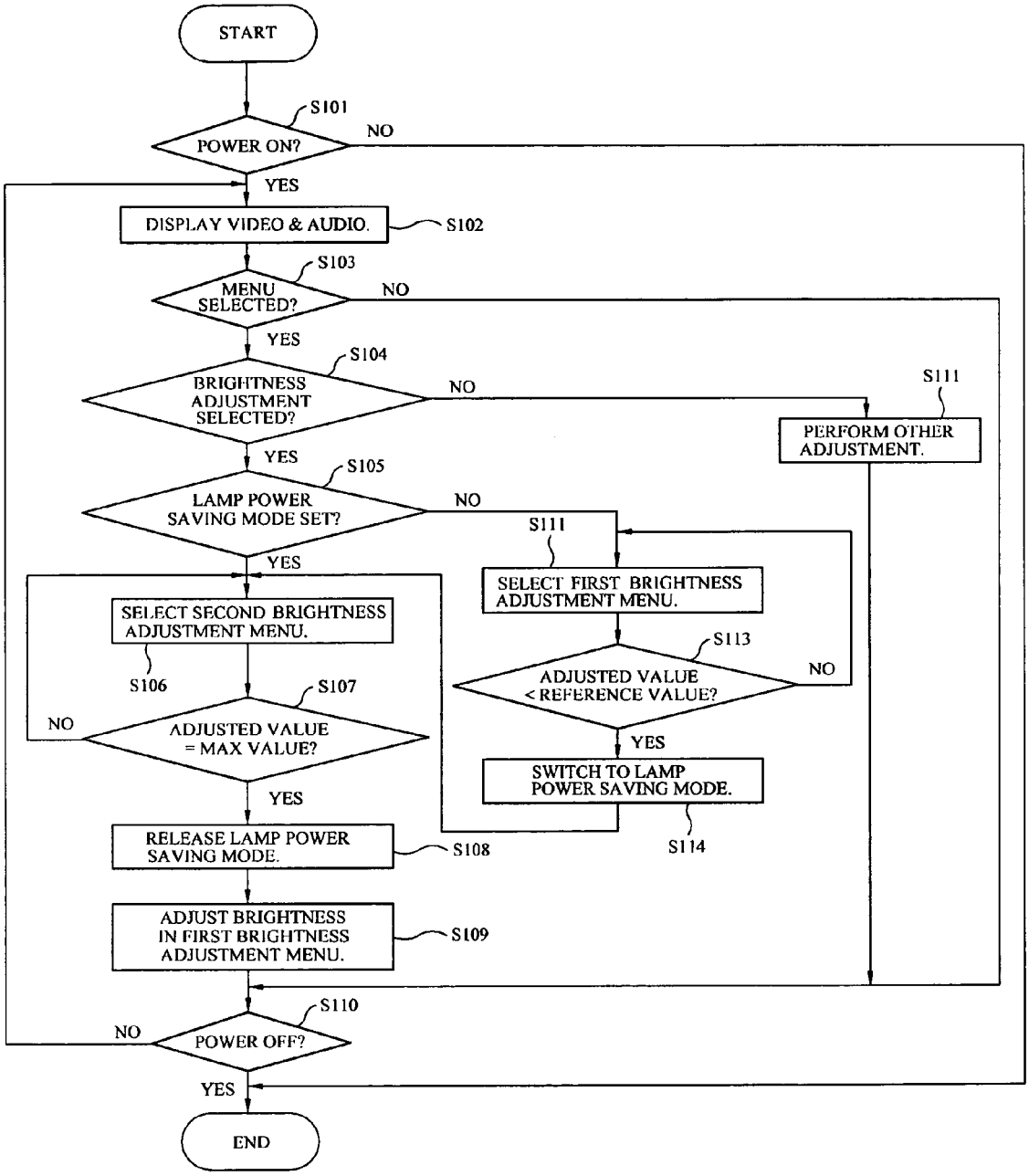
FIG. 2 is a flowchart illustrating a brightness control method for a video display appliance according to an embodiment of the present invention.
Figure 3:
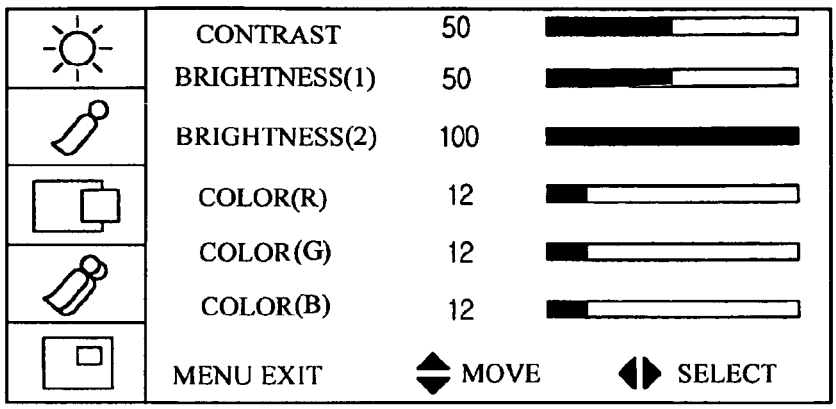
FIG. 3 is a view illustrating a brightness adjustment menu of a video display appliance according to the present invention.

FIG. 1 is a block diagram illustrating a brightness control apparatus for a video display appliance according to an embodiment of the present invention, and FIG. 2 is a flowchart illustrating a brightness control method for a video display appliance according to an embodiment of the present invention. FIG. 3 is a view illustrating a brightness adjustment menu of a video display appliance according to the present invention.

As illustrated in FIG. 1, the video display appliance according to the present invention includes a key input unit 101 for inputting user's request commands, a memory 102 for storing various kinds of menus for controlling the whole operation of the appliance if the user's request commands are input through the key input unit 101, a display unit 104 for displaying the menus stored in the memory 102 and video signals, a control unit 103 for operating to automatically switch a present mode over to a lamp power saving mode according to a result of comparing a display brightness value being adjusted by the user with a reference brightness value pre-stored in the memory 102 if the user selects a brightness adjustment menu from the menus being displayed on the display unit 104, and a lamp driving unit 105 for driving a lamp 106 according to a control signal output from the control unit 103.

The operation of the brightness control apparatus for a video display appliance as constructed above will be explained.

If the user inputs a power-on command through the key input unit 101, the control unit 103 drives the lamp 106 and controls the display unit 104 to display a video signal corresponding to a received broadcasting signal.

In this case, if the user wants to adjust the brightness of the video display appliance, he/she selects a desired brightness value through a menu for adjusting brightness selected among adjustment menus displayed on the display unit 104 as illustrated in FIG. 3, and the control unit 103 controls the lamp driving unit 105 to drive the lamp 106 according to the brightness value selected by the user. Additionally, the control unit 103 judges whether the display brightness value selected by the user becomes smaller than the brightness value that corresponds to the preset lamp power saving mode, and switches the present mode to the lamp power saving mode if the selected brightness value is smaller than the brightness value corresponding to the lamp power saving mode.

In this case, the menu for adjusting the brightness includes a first brightness adjustment menu for adjusting the brightness in a general mode and a second brightness adjustment menu for adjusting the brightness in the lamp power saving mode.

In the lamp power saving mode, the user can adjust the brightness using the second brightness adjustment menu even if the adjusted brightness value becomes lower than the preset reference brightness value.

More specifically, the user adjusts the brightness using the first brightness adjustment menu, and if the adjusted brightness value becomes smaller than the preset reference value, the present mode is automatically switched over to the lamp power saving mode. In the lamp power saving mode, the user adjusts the brightness using the second brightness adjustment menu.

Now, a brightness control method for a video display appliance according to the present invention will be explained with reference to FIG. 2.

If the user inputs a power-on command through the key input unit 101, the control unit outputs video and audio signals corresponding to a received broadcasting signal (steps S101 and S102).

Then, the control unit judges whether the user selects adjustment menus (step S103).

If the user selects the adjustment menus as a result of judgment at step S103, the control unit judges whether the user selects a brightness adjustment menu (step S104).

If the user selects the brightness adjustment menu as a result of judgment at step S104, the control unit judges whether a lamp power saving mode is set (step S105).

If the lamp power saving mode is set as a result of judgment at step S105, the control unit selects a second brightness adjustment menu, and then adjusts the brightness (step S106).

If the adjusted value is the maximum value for the adjustment, the control unit releases the lamp power saving mode (steps S107 and S108). If the lamp power saving mode is released, the brightness can be adjusted over the preset reference brightness value.

Then, the brightness adjustment operation is performed through a first brightness adjustment menu (step S109).

If the user inputs a power-off command, the brightness adjustment operation is terminated (step S110).

Meanwhile, if the lamp power saving mode is not set as a result of judgment at step S105, the control unit selects the first brightness adjustment menu, and then adjusts the brightness according to the user's selection (step S112).

Then, the control unit judges whether the adjusted value is below the preset reference brightness value (step S113).

The preset reference brightness value is obtained by increasing the brightness value measured not in the lamp power saving mode up to the brightness value that corresponds to a state that the lamp power saving mode is on.

If the adjusted value is below the preset reference value as a result of judgment at step S113, the control unit switches the present mode to the lamp power saving mode, and then enters into the step S106 (step S114).

Meanwhile, if the user does not select the brightness adjustment menu as a result of judgment at step S104, the control unit performs an adjustment operation according to the user's selection of another menu (step S111).

As described above, according to the brightness control apparatus and method of the present invention, the present mode is automatically switched over to the lamp power saving mode if the adjusted brightness value becomes smaller than the preset reference brightness value during the user's selection of the brightness value. Additionally, if the lamp power saving mode is set, the brightness is controlled using a separate second brightness adjustment menu.

That is, if the present mode is not the lamp power saving mode, the brightness is adjusted using the first brightness adjustment menu, while if the present mode is the lamp power saving mode, the brightness is adjusted using the second brightness adjustment menu.

The brightness control apparatus and method for a video display appliance according to another embodiment of the present invention will now be explained with reference to FIGS. 4 and 5.

Figure 4:
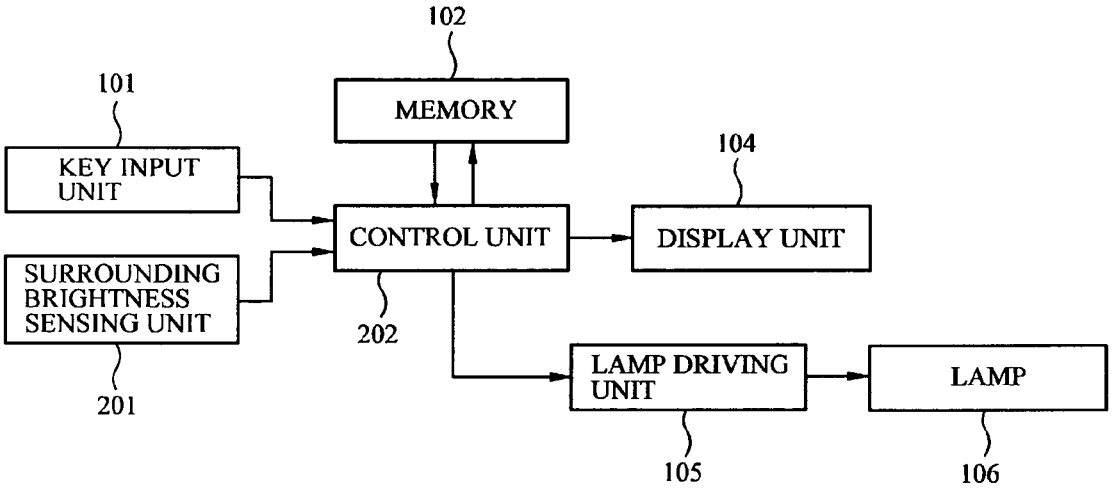
FIG. 4 is a block diagram illustrating a brightness control apparatus for a video display appliance according to another embodiment of the present invention.
Figure 5:
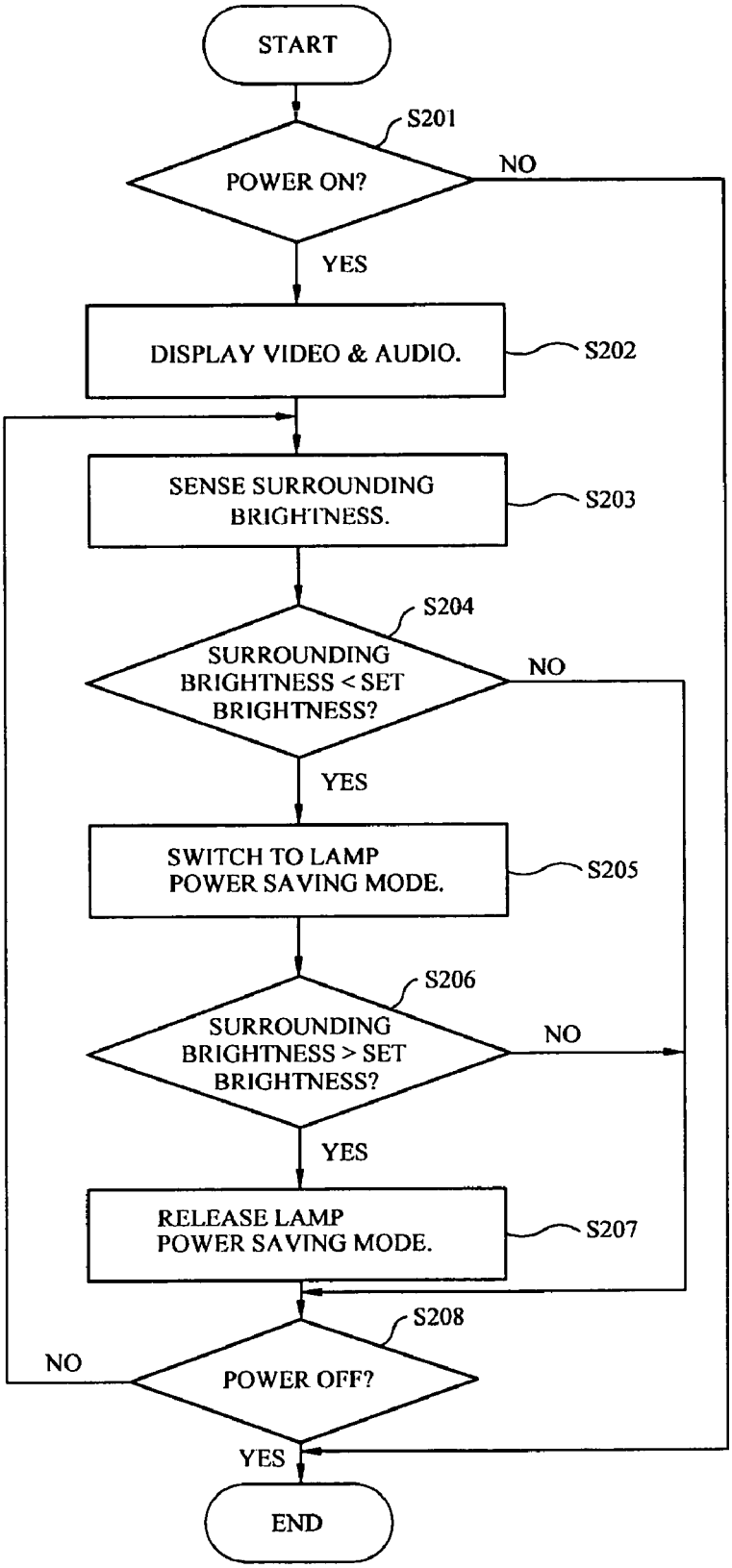
FIG. 5 is a flowchart illustrating a brightness control method for a video display appliance according to another embodiment of the present invention.

The same reference numbers are used in FIGS. 1 and 4 to refer to the same constituent elements.

As illustrated in FIG. 4, the brightness control apparatus for a video display appliance according to another embodiment of the present invention includes a key input unit 101 for inputting user's request command, a surrounding brightness sensing unit 201 for sensing a surrounding brightness of the video display appliance, a memory 102 for storing various kinds of menus for controlling the whole operation of the appliance, a display unit 104 for displaying the various kinds of menus stored in the memory 102 and video signals, a control unit 202 for outputting control signals according to the user's request commands input through the key input unit 101 and operating to switch the present mode over to a lamp power saving mode according to the surrounding brightness sensed by the surrounding brightness sensing unit 201, and a lamp driving unit 105 for driving a lamp 106 according to the control signals output from the control unit 202.

The operation of the brightness control apparatus for a video display appliance as constructed above will be explained.

If the user inputs a power-on command through the key input unit 101, the video display appliance outputs video and audio signals corresponding to a received broadcasting signal.

The control unit 202 controls the surrounding brightness sensing unit 201 to sense a surrounding brightness of the video display appliance, and if the sensed brightness value is smaller than the preset value, the control unit 202 recognizes this and outputs a control signal to the lamp driving unit 105 so that the present mode is automatically switched over to the lamp power saving mode.

Meanwhile, the control unit 202 releases the lamp power saving mode if the surrounding brightness value sensed through the surrounding brightness sensing unit 201 is larger than the preset value.

Now, a brightness control method for a video display appliance according to another embodiment of the present invention will be explained with reference to FIG. 5.

The control unit judges whether the user inputs a power-on command (step S201).

If the power-on command is input as a result of judgment at step S201, the control unit outputs video and audio signals corresponding to a received broadcasting signal (step S202).

Then, the control unit operates to sense the surrounding brightness (step S203), and then judges whether the sensed surrounding brightness value is smaller than the preset brightness value (step S204).

If the sensed surrounding brightness value is smaller than the preset brightness value as a result of judgment at step S204, the control unit switches the present mode to the lamp power saving mode (step S205).

Additionally, the control unit continuously judges whether the surrounding brightness value is larger than the preset brightness value after switching the present mode to the lamp power saving mode (step S206).

If the surrounding brightness value is larger than the preset brightness value as a result of judgment at step S206, the control unit releases the lamp power saving mode (step S207).

Accordingly, as the lamp power saving mode is released, the surrounding brightness value becomes larger than the preset reference brightness value.

Then, if the user inputs a power-off command, the surrounding brightness control operation is terminated (step S208).

Consequently, in the embodiment of the present invention, the surrounding brightness is sensed and the display brightness is controlled in association with the lamp power saving mode in accordance with the sensed surrounding brightness. That is, if the surrounding brightness value is smaller than the preset brightness value, the present mode is switched over to the lamp power saving mode, and then if the surrounding brightness value is larger than the preset brightness value, the lamp power saving mode is released.

As described above, according to the present invention has the following effects:

First, if the user adjusts the display brightness below a predetermined brightness value, the present mode is automatically switched over to the lamp power saving mode.

Second, if the surrounding brightness value is smaller than a preset brightness value, the video display appliance operates in the lamp power saving mode, and thus the power consumption of the lamp can be reduced.

Third, using the lamp power saving mode, the lifetime of the lamp can be lengthened.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A brightness control method for a video display appliance having a lamp and a memory, comprising:

outputting video and audio signals if power is applied to the appliance;

displaying various kinds of menus pre-stored in the memory according to a user's selection; and controlling to automatically switch a present mode over to a lamp power saving mode according to a result of comparing an adjusted display brightness value with a reference brightness value pre-stored in the memory, wherein controlling to automatically switch a present mode over to a lamp power saving mode includes adjusting a display brightness according to the display brightness value with adjusting a brightness of the lamp when the adjusted display brightness value becomes smaller than the reference brightness value and the present mode is not the lamp power saving mode, and adjusting brightness according to the display brightness value and adjusts a brightness of the lamp when the adjusted display brightness value becomes larger than the reference brightness value and the present mode is the lamp power saving mode.

2. The brightness control method as claimed in claim 1, wherein the step of displaying the various kinds of menus pre-stored in the memory displays a menu for adjusting contrast and color, a first brightness adjustment menu for adjusting the brightness in a general mode, and a second brightness adjustment menu for adjusting the brightness in the lamp power saving mode.

3. The brightness control method as claimed in claim 1, wherein controlling to automatically switch the present mode over to the lamp power saving mode includes:

judging whether the lamp power saving mode is pre-selected;

judging whether the brightness value adjusted using the first brightness adjustment menu becomes smaller than the reference brightness value pre-stored in the memory if the lamp power saving mode is not selected; and automatically switching the present mode over to the lamp power saving mode when the adjusted brightness value becomes smaller than the reference brightness value pre-stored in the memory as a result of judgment.

4. The brightness control method as claimed in claim 3, wherein controlling to automatically switch the present mode over to a lamp power saving mode further includes:

adjusting the brightness using the second brightness adjustment menu if the lamp power saving mose is pre-selected; and releasing the lamp power saving mode when the adjusted brightness value is a maximum value of the second brightness adjustment menu.

5. The brightness control method as claimed in claim 1, wherein the controlling includes determining whether the brightness value being adjusted using a first brightness adjustment menu becomes smaller than the pre-stored reference brightness value and automatically switching to the lamp power saving mode when the brightness value being adjusted is determines to become smaller than the pre-stored reference brightness value.

6. The brightness control method as claimed in claim 5, further comprising adjusting the brightness value when the user uses a second brightness adjustment menu in the lamp power saving mode.

7. the brightness control method as claimed in claim 6, further comprising releasing the lamp power saving mode when the brightness value being adjusted using the second brightness adjustment menu becomes a predetermined value of the second brightness adjustment menu.

8. The brightness control method as claimed in claim 7, wherein the predetermined value is a maximum value of the second brightness adjustment menu.

9. The brightness control method as claimed in claim 7, wherein the first brightness adjustment menu is different than the second brightness adjustment menu.

10. A brightness control apparatus for a video display appliance having a lamp, comprising:

a memory for storing various kinds of menus for controlling an operation of the appliance;

a display unit for displaying the menus stored in the memory and a video signal;

a control unit for operating to automatically switch a present mode over to a lamp power saving mode according to a result of comparing an adjusted display brightness value with a reference brightness value pre-stored in the memory; and a lamp driving unit for driving the lamp according to a control signal output from the control unit, wherein the control unit operates to automatically switch the present mode to the lamp power saving mode when the adjusted display brightness value becomes smaller than the reference brightness value pre-stored in the memory, and the control unit adjusts the display brightness according to the display brightenss value and adjusts a brightness of the lamp when the adjusted display brightness value becomes larger than the reference brightness value and the present mode is the lamp power saving mode.

11. The brightness control apparatus as claimed in claim 10, wherein the menu for adjusting the brightness included a first brightness adjusting menu for adjusting a general brightness and a second brightness adjustment menu for adjusting the brightness in the lamp power saving mode.

12. The brightness control apparatus as claimed in claim 11, wherein the first brightness adjustment menu is different than the second brightness adjustment menu.

13. The brightness control apparatus as claimed in claim 10, wherein the control unit determines whether the brightness value being adjusted using a first brightness adjustment menu becomes smaller than the pre-stored reference brightness value and the control unit automatically switches to the lamp power saving mode when the control unit determines that the brightness value adjusted becomes smaller than the pre-stored reference brightness value.

14. The brightness control apparatus as claimed in claim 13, wherein the control unit adjusts the brightness value when the user uses a second brightness adjustment menu in the lamp power saving mode.

15. The brightness control apparatus as claimed in claim 14, wherein the control unit releases the lamp power saving mode when the brightness value being adjusted using the second brightness adjustment menu becomes a predetermined value of the second brightness adjustment menu.

16. The brightness control apparatus as claimed in claim 11, wherein the first brightness adjustment menu is different than the second brightness adjustment menu.

* * * * *